US005661512A

United States Patent [19]

Fukuda et al.

[11] Patent Number: 5,661,512

[45] Date of Patent: Aug. 26, 1997

[54] THERMAL PRINTER AND THERMAL HEAD CONTROL METHOD

[75] Inventors: Hiroshi Fukuda; Kazuo Miyaji, both of Saitama, Japan

[73] Assignee: Fuji Photo Film Co., Ltd., Kanagawa, Japan

[21] Appl. No.: 383,097

[22] Filed: Feb. 3, 1995

[30] Foreign Application Priority Data

Feb. 16, 1994 [JP] Japan ..... 6-0198658

[51] Int. Cl.[6] ..... B41J 2/36

[52] U.S. Cl. ..... 347/175; 347/211; 347/191; 347/186; 347/188

[58] Field of Search ..... 347/175, 211, 347/191, 186, 188; 400/120.03, 120.11, 120.08, 120.09

[56] References Cited

U.S. PATENT DOCUMENTS

| | | | |
|---|---|---|---|
| 4,639,741 | 1/1987 | Inoue | 347/182 |
| 4,734,704 | 3/1988 | Mizutani et al. . | |
| 5,398,050 | 3/1995 | Sato | 347/172 |

FOREIGN PATENT DOCUMENTS

| | | | |
|---|---|---|---|
| 62-196161 | 8/1987 | Japan | 347/211 |

*Primary Examiner*—Huan H. Tran

[57] ABSTRACT

A thermal printer has a thermal head, which includes plural heating elements arranged in a main scanning direction. The heating elements are driven while the thermal head and a color thermosensitive recording sheet are moved relatively in a sub scanning direction perpendicular to the main scanning direction. The heating elements apply bias heat energy and image heat energy to the recording sheet, thermally to record an ink dot on the recording sheet. The bias heat energy is determined to heat the recording sheet substantially to a temperature at which the recording sheet starts being colored. The image heat energy is determined in accordance with image data of a halftone image. Density correcting heat energy is additionally applied to the recording sheet through heating elements located in end positions in the thermal head. The heating elements of the end positions are so located that heat escapes therefrom fastest of the plural heating elements. The correcting heat energy is determined to make the heating elements of the end positions as hot as heating elements in a middle position. The density of the ink dot is regularized with reference to the main scanning direction.

26 Claims, 7 Drawing Sheets

DRIVE DATA (NG≧C, NB≧C)
17a
17b
17n
48a
48b
48n
47
AND GATE ARRAY
46
LATCH CKT ARRAY
45
SHIFT REGISTER
LATCH SIGNAL
41
COMPARATOR
C
CLOCK
43
PRINTING CONTROLLER
44
STROBE SIGNAL GENERATOR
40
NG
NB
1-LINE START
1-LINE END
32
1ST LINE MEMORY
33
2ND LINE MEMORY
34
3RD LINE MEMORY
42
MEMORY CONTROLLER
P
Q
31
NG
NB
35
SYS 1-LINE START
SYS 1-LINE END
30
FRAME MEMORY
SYSTEM CONTROLLER
36
RAM
38
ROM

THERMAL PRINTER AND THERMAL HEAD CONTROL METHOD

BACKGROUND OF THE INVENTION

1. Field of the Invention

The present invention relates to a thermal printer and a thermal head control method. More particularly, the present invention relates to an improvement of a thermal printer and a thermal head control method, in which a thermal head can be so operated that coloring density of recording material is prevented from being influenced by irregular escapement of heat.

2. Description Related to the Conventional Art

There are thermal transfer printers and direct thermal printers known in the art. The thermal transfer printers are classified into a thermal die transfer type and a thermal wax transfer type. In either of them, an ink ribbon or ink film is overlapped on a recording medium. A thermal head is pressed against the ink film toward the recording medium and at the same time driven to apply heat to them. The ink of the ink film is transferred to the recording medium. In the direct thermal printer on the other hand, a thermosensitive recording material is heated by a thermal head, directly to develop color in the thermosensitive recording material, to form an image on it.

The thermal head of the thermal printer consists of plural heating elements. For the recording of one pixel, the heating elements are supplied with at least one drive pulse for bias heating (bias pulse) and plural drive pulses for image heating (image pulses) in a number associated with density for the pixel of a halftone image or a character image. The bias pulses are used for heating the recording material to a temperature at which development of color starts in the thermosensitive material or before transfer of ink of the ink film. In the direct thermal printer, a color thermosensitive recording sheet is mounted on the periphery of a platen drum. The thermal head is contacted on the recording sheet. The platen drum is driven to make three rotations. In each rotation one of the three colors is recorded on the recording sheet, so that the three colors are recorded in frame-sequential fashion. A full color image is obtained on the recording sheet. The color thermosensitive recording sheet is disclosed in U.S. Pat. No. 4,734,704 (corresponding to Japanese Patent Laid-open Publication No. 61-213169), and consists of a support and cyan, magenta and yellow thermosensitive coloring layers formed on the support in the order listed.

In the recording sheet, the cyan coloring layer, which is the closest to the reverse surface of the recording sheet, has the lowest heat sensitivity of the three coloring layers, and requires considerably high heat energy to be colored. In the recording, great heat before escapement is accumulated in the whole of the thermal head, so that the accumulated heat of the thermal head influences distribution of the temperature through the heating elements. Such influences are remarkable in the recording with the coloring layers closest to the reverse side of the sheet. To be precise, the thermal head has lower temperature in the end positions than in the middle position, as viewed with reference to the main scanning direction, because greater areas around the ends of the thermal head are subjected to ambient air. The density of the printed image is lowered to an unwanted extent in the end positions relative to the main scanning direction. The coloring layers in the recording sheet are different in the heat sensitivity. In the thermal head having been driven, heat remains before escapement. Upon the recording of the colors, the remaining heat in the thermal head is different between the colors. There occurs a problem in that the gray balance of the reproduced image is irregular in the end positions relative to the main scanning direction. The fidelity in reproduction in color is remarkably low.

SUMMARY OF THE INVENTION

In view of the foregoing problems, an object of the present invention is to provide a thermal printer and a thermal head control method, in which density of a printed image is prevented from being lowered partially relative to a direction of arrangement of heating elements of a thermal head.

Another object of the present invention is to provide a thermal printer and a thermal head control method, in which a gray balance can be reproduced with high fidelity.

In order to achieve the above and other objects and advantages of this invention, density correcting heat energy is additionally applied to the recording material through a first group of heating elements in the thermal head. The heating elements of the first group are so located that heat escapes therefrom fastest of the plural heating elements. The density correcting heat energy is adapted to preventing density from being lowered with escapement of the heat.

In a preferred embodiment, a thermal printer has a bias data memory, which stores bias data representing a pulse number of the bias pulse train for the heating elements. The bias pulse train includes basic bias pulses and the density correcting pulses. The basic bias pulses are produced in such a number that the heating elements of a first group heat the recording material substantially to the temperature of starting coloring of the recording material, where the heating elements of the first group lie in a middle of the thermal head. The density correcting pulses are supplied for a second group of heating elements lying in positions close to two ends of the thermal head with reference to the main scanning direction. The density correcting pulses are produced in such a number as to compensate heat deficit caused by heat escapement from the thermal head. A bias data line memory stores the bias data of one line for each of the heating elements, the bias data read out of the bias data memory. An image data line memory stores the image data of the one line. The image data represents a pulse number of the image pulse train for the heating elements. A driver section reads the bias data of the one line out of the bias data line memory, reads the image data of the one line out of the image data line memory, and converts the bias data and the image data respectively into the bias pulse train and the image pulse train following the bias pulse train, to record the ink dot of the one line.

In the present invention, the density of a printed image is prevented from being lowered partially relative to a direction of arrangement of the heating elements of the thermal head. The gray balance of the image can be reproduced with high fidelity.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
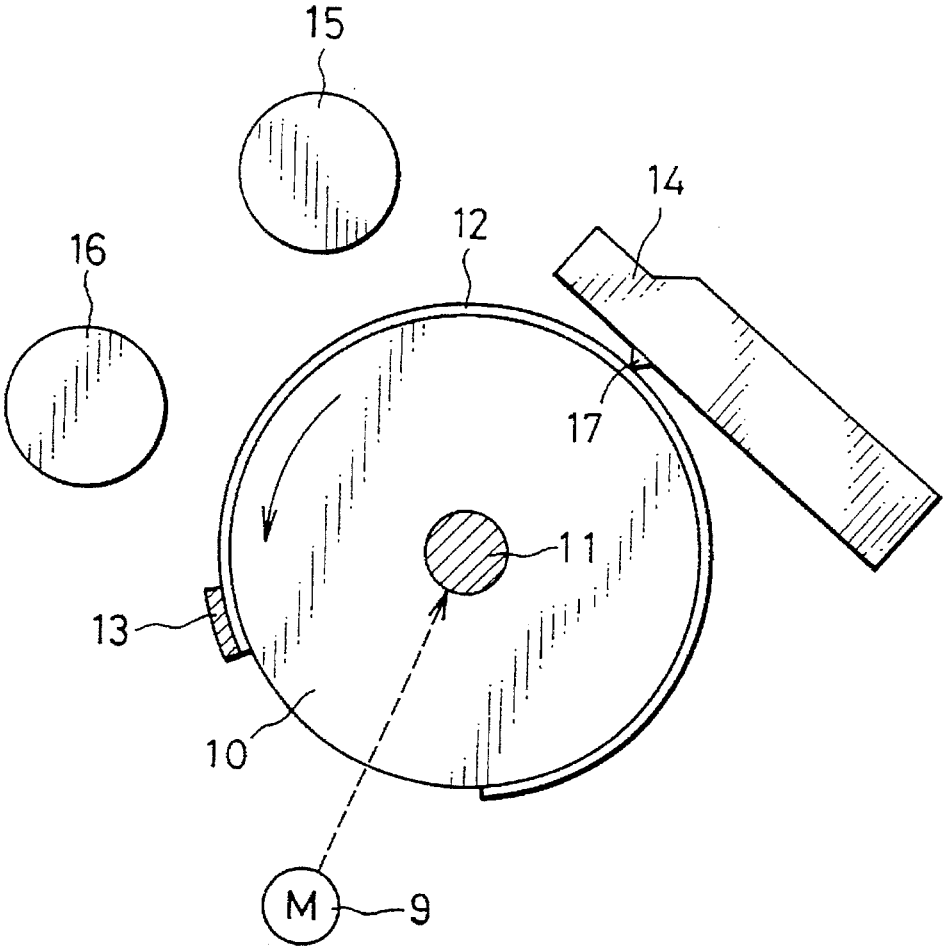
FIG. 1 is an explanatory view schematically illustrating a construction of a thermal printer.

In FIG. 1, a color thermal printer of a direct thermal printing type has a platen drum 10, which is supported about a rotary shaft 11, and driven by a stepping motor 9. To print an image, the motor 9 rotates the platen drum 10 in the arrow direction. On the periphery of the platen drum 10, a color thermosensitive recording sheet 12 is fitted. An edge of the recording sheet 12 is fixedly retained on the platen drum 10 by a clamp 13. There are disposed a thermal head 14, an ultraviolet lamp 15 for fixing magenta color, and an ultraviolet lamp 16 for fixing yellow color, in positions close to the platen drum 10.

A bottom of the thermal head 14 has an array 17 of heating elements. The heating elements are arranged linearly in the direction parallel to the shaft 11 of the platen drum 10. In thermal recording of one pixel, each of the heating elements provides the recording sheet 12 with bias heat energy and image heat energy. The bias heat energy heats the recording sheet 12 to the temperature at which the recording sheet 12 starts being colored. The image heat energy heats the recording sheet 12 in consideration of coloring density to be reproduced in a halftone image. The magenta fixing lamp 15 emanates ultraviolet or near-ultraviolet rays peaking nearly at 365 nm of the wavelength. The yellow fixing lamp 16 emanates ultraviolet or near-ultraviolet rays peaking nearly at 420 nm of the wavelength.

Figure 2:
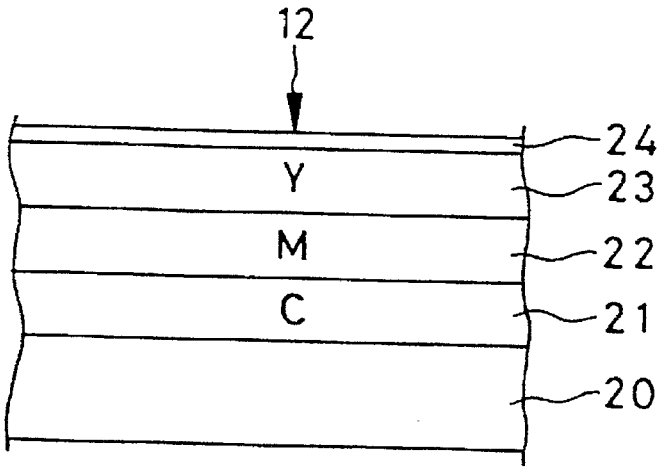
FIG. 2 is an explanatory view illustrating a layered structure of a color thermosensitive recording sheet.

As illustrated in FIG. 2, the color thermosensitive recording sheet 12 includes a support 20, a cyan thermosensitive coloring layer 21, a magenta thermosensitive coloring layer 22, a yellow thermosensitive coloring layer 23, and a protective layer 24 in the order listed. The magenta layer 22 has a photochemical fixability to ultraviolet rays having a wavelength of nearly 365 nm. The yellow layer 23 has a photochemical fixability to ultraviolet rays having a wavelength of nearly 420 nm. Among the three coloring layers 21 to 23, the yellow layer 23 is the closest to the obverse face of the recording sheet 12, and is heated the earliest to record an image. The cyan layer 21 is the closest to the reverse face of the recording sheet 12, and is heated the latest to record an image.

Figure 3:
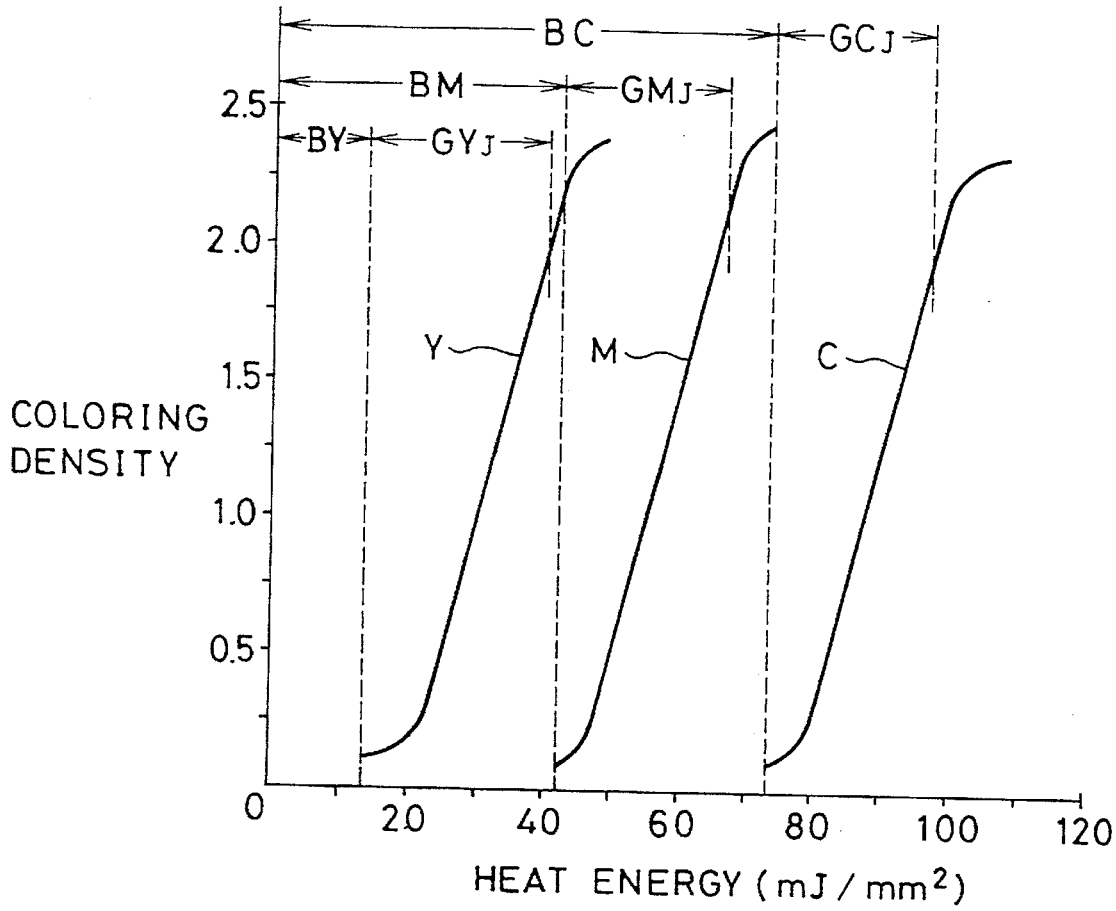
FIG. 3 is a graph illustrating coloring characteristics of thermosensitive coloring layers of the recording sheet.

FIG. 3 illustrates coloring characteristics of each coloring layer. In the recording sheet 12 herein, the yellow coloring layer 23 to be colored requires the smallest heat energy among the three layers. The cyan coloring layer 21 to be colored requires the greatest heat energy. For the recording of the yellow at a pixel, bias heat energy BY and image heat energy $GY_J$ are added up, to apply the heat energy as their sum to the recording sheet 12. The bias heat energy BY is predetermined as constant, and is as great as the energy for starting coloring the yellow coloring layer 23. The image heat energy $GY_J$ is determined in accordance with a halftone level J corresponding to coloring density for the pixel designated in the recording. The recording of the magenta and cyan colors M and C is effected similarly.

Figure 4:
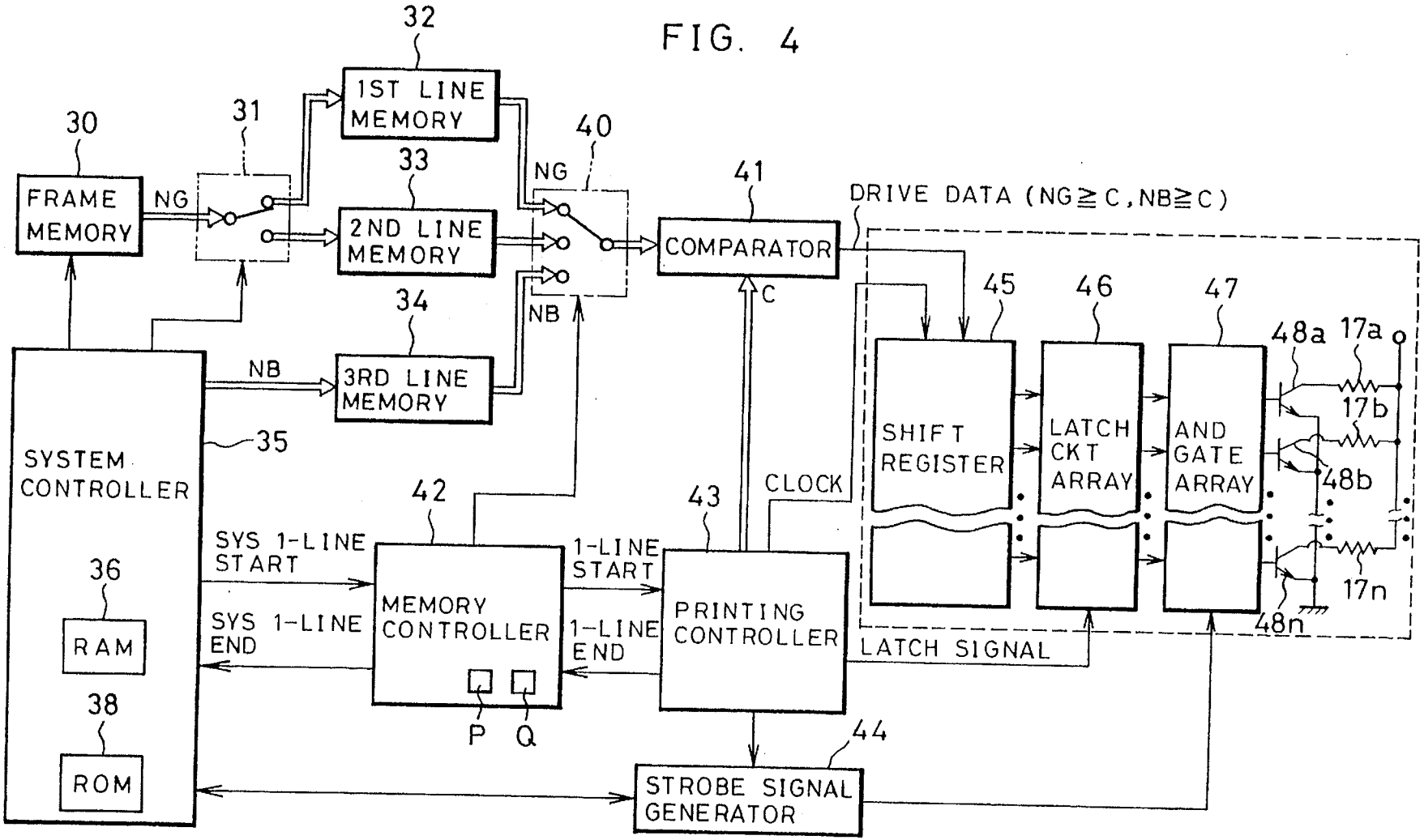
FIG. 4 is a block diagram illustrating circuitry of a driver section of a thermal head.

In FIG. 4 illustrating the circuitry for printing, an image data of one frame photographed by an electronic still camera is written in a frame memory 30 in a form separated color from color. In the embodiment, the image data is stored as a pulse number data NG, which consists of the number of drive pulses for reproducing the halftone. Those drive pulses for the halftone are hereinafter referred to as "image pulses". A system controller 35 reads the image pulse number data NG out of the frame memory 30 by one line and for a color to be printed. The image pulse number data NG is written to one of first and second line memories 32 and 33 as selected through a first selector 31. The selector 31 is so controlled by the system controller 35 that the image pulse number data NG of lines having odd numbers are written to the first line memory 32, and the image pulse number data NG of lines having even numbers are written to the second line memory 33.

Figure 6:
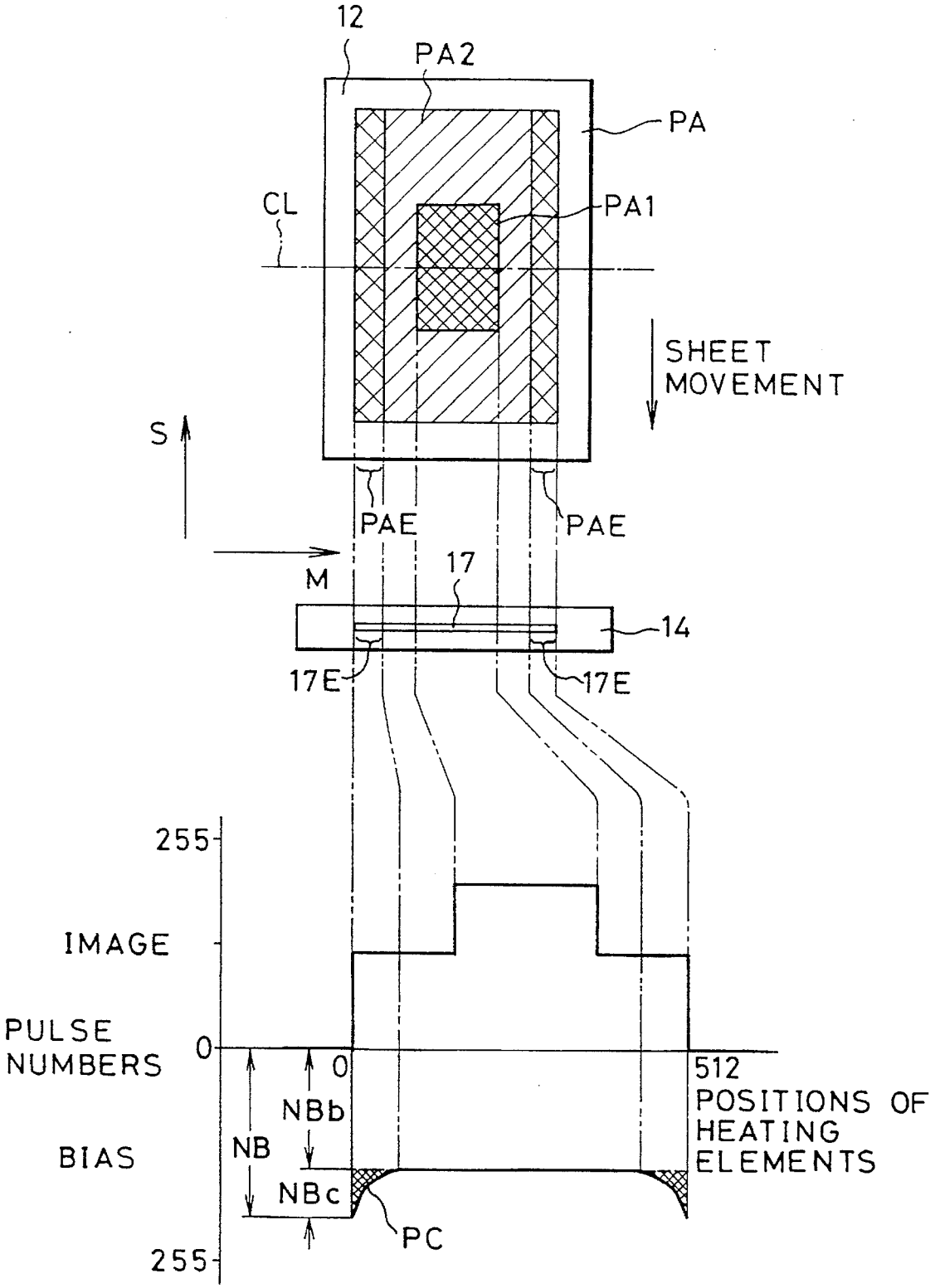
FIG. 6 is an explanatory view illustrating image data, bias data, the thermal head, and the image pattern recorded according thereto.

The system controller 35 consists of a microcomputer, and controls relevant circuits in sequential fashion. In an initial step of operation upon powering the printer, the system controller 35 writes a pulse number data NB of bias pulses to a third line memory 34. Note that the bias pulses herein referred to are used in driving each heating element for the bias heating. The bias pulse number data NB is determined to regularize the distribution of temperature with reference to the main scanning direction M of the thermal head, and has been obtained in previous experimental operation. To be precise, the distribution in density of a printing area PA as formed after the printing is measured relative to the main scanning direction M. The numbers of additional pulses driving each heating element are determined to raise density in shoulder portions of the distribution as high as that of the plateau portion of the distribution. As illustrated in FIG. 6, the number data NBc of correcting pulses PC is added to the pulse number data NBb of the basic bias pulse train, to obtain the bias pulse number data NB for each heating element. The bias pulse number data NB is associated with the plural heating elements, and previously stored in predetermined region in the ROM 38 (See FIG. 4) in the system controller 35. In the embodiment, the maximum of the number of the bias pulses is 255.

Figure 5:
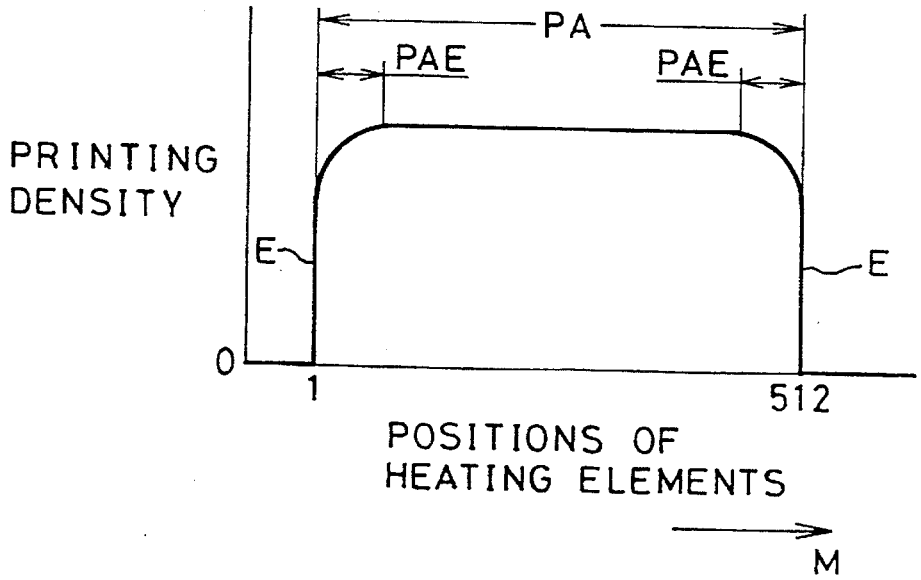
FIG. 5 is a graph illustrating density distribution of a printing area in relation to a main scanning direction, prior to density correction according to the present invention.
Figure 7:
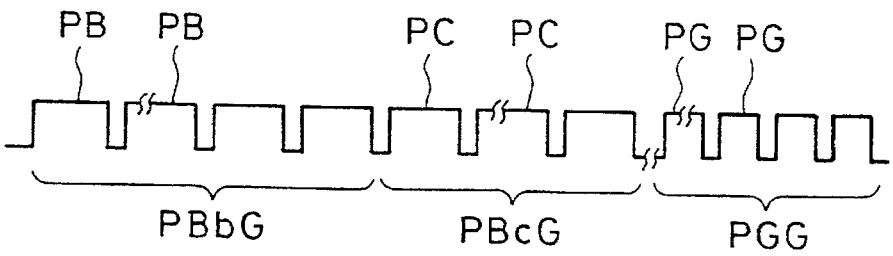
FIG. 7 is an explanatory view illustrating a train of drive pulses applied to the heating elements located in the end positions.

FIG. 5 illustrates falls in density which would not be corrected in relation to the main scanning direction M defined by the thermal head 14. Although the middle of the recording sheet 12 has sufficiently flat distribution in density, the lateral portions PAE have lower density, and decrease toward the edges E of the printing areas PA. For heating elements 17E of end positions, correcting pulse train PBcG defined by correcting pulses of a predetermined number, as illustrated in FIG. 7, is added to the basic bias pulse train PBbG defined by the basic bias pulses PB. In FIG. 6, the number data NBc of the correcting pulses PC is determined in increasing fashion toward the end positions E among the end heating elements 17E. The distribution of the temperature in the lateral portions PAE relative to the main scanning direction of the printing area PA is regularized at the end of the bias heating. Thus no irregularity in density occurs in relation to the main scanning direction. Note that the number data NBc of the correcting pulses is added to number data NBb of the basic bias pulses, to obtain the sum as bias pulse number data NB, which is previously written in a ROM 38, either before shipment of the thermal printer out of a manufacturing factory, or in conditioning the thermal printer after renewal of the thermal head 14.

In FIG. 4, the system controller 35, upon receiving the print start signal, generates a SYS 1-LINE START signal, and sends it to a memory controller 42. The memory controller 42 changes a selector 40 upon receiving the SYS 1-LINE START signal and the 1-LINE END signal, and generates a SYS 1-LINE END signal and a 1-LINE START signal.

The memory controller 42 receives the SYS 1-LINE START signal from the system controller 35, and then changes over the selector 40 to connect the third line memory 34 to a comparator 41. The memory controller 42 also sends the 1-LINE START signal to a printing controller 43. The memory controller 42 includes counters P and Q. The counter P counts occurrences of the SYS 1-LINE START signal from the system controller 35, to have a count p. The counter Q counts occurrences of the 1-LINE END signal generated from the printing controller 43, to have a count g. The memory controller 42 changes the selector 40 in accordance with the counts p and g, and generates the 1-LINE START signal and the SYS 1-LINE END signal. If the count p is an odd number, then the first line memory 32 is connected to the comparator 41, while the 1-LINE START signal is sent to the printing controller 43. If the count p is an even number, then the second line memory 33 is connected to the comparator 41, while the 1-LINE START signal is sent to the printing controller 43. If the count g is an even number, then the SYS 1-LINE END signal is sent to the system controller 35.

To the selector 40, the first to third line memories 32, 33 and 34 are connected. The selector 40 transmits data from only one of the line memories to the comparator 41.

The printing controller 43, upon receiving the print start signal of one line from the memory controller 42, sends 8-bit comparative data C to the comparator 41 in serial fashion. The printing controller 43 is counting occurrences of 1-LINE START signal. Upon an occurrence of the 1-LINE START signal for a time of an odd number in the course of plural occurrences, then the printing controller 43 sends the comparative data C to the comparator 41 for producing the bias pulses. Upon an occurrence of the 1-LINE START signal for an even-numbered time among the plural occurrences, then the printing controller 43 sends the comparative data C to the comparator 41 for producing the image pulses. For example, the comparative data C from "1" to "FF" for the bias pulses are generated serially as indicated in the hexadecimal notation. The comparative data C from "1" to "FF" for the image pulses are also generated serially. In the embodiment, the halftone is reproduced in 255 steps by the virtue of the comparative data C from "1" to "FF" in the hexadecimal notation. It is possible to change the number of steps in reproducing the halftone by changing the comparative data C suitably for the characteristics of each of the coloring layers.

The comparator 41, receiving "1" as comparative data C from the printing controller 43, compares the comparative data C with the bias pulse number data NB for each heating element. If the bias pulse number data NB is equal to or greater than the comparative data C, then the drive data "1" is obtained. The drive data of one line obtained by the comparison is sent to a shift register 45 as a serial signal. Upon the end of the comparison with "1" as comparative data C, the printing controller 43 generates "2" as comparative data C and sends it to the comparator 41. The comparator 41 compares "2" with the bias pulse number data NB of the one line for each heating element. Repeatedly, "1" to "FF" as comparative data C are compared with the bias pulse number data NB, which, namely, is compared for 255 times, and converted into drive data of at most 255 bits. The drive data is sent to the shift register 45 in successive 255 steps. The serial drive data produced by the repeated comparison is shifted in the shift register 45 by the clock from the printing controller 43, and converted into parallel drive data. Thus at most 255 bias pulses are generated past the comparator 41. Then generation of the comparative data C of one line is ended. The printing controller 43 sends 1-LINE END signal to the memory controller 42 to signal the end of the recording of the one line.

In use of the comparative data C from "1" to "FF", the image pulse number data NB of each heating element is compared for 255 times, and converted to drive data of at most 255 bits. The drive data is sent to the shift register 45 at 255 times. At the end of the generation of the comparative data C of one line, the printing controller 43 provides the memory controller 42 with the I-LINE END signal, which represents the end of the recording of the one line.

The drive data, converted in parallel form by the shift register 45, is latched by a latch circuit array 46 in synchronism with a latch signal. An AND gate array 47 operates in such a manner that, if it receives the strobe signal, and if "1" as drive data is being entered in the AND gate array 47, then the AND gate array 47 generates "1" as a drive pulse.

To each of the outputs of the AND gate array 47, transistors **48*a* to 48*n* are connected. Each transistor is turned on upon receiving a drive pulse. There are linearly arranged heating elements 17*a* to 17*n* connected to the transistors 48*a* to 48*n* in serial fashion. Each of the heating elements 17*a* to 17*n*** consists of a resistor.

A strobe signal generator 44 is controlled by signals from the system controller 35 and the printing controller 43, and generates strobe signals for determining durations of turning on/off the heating elements **17*a* to 17*n***. There are two kinds of the strobe signals: for the bias heating and the image heating. The strobe signal for the bias heating has a greater pulse width than the strobe signal for the image heating.

Figure 8A:
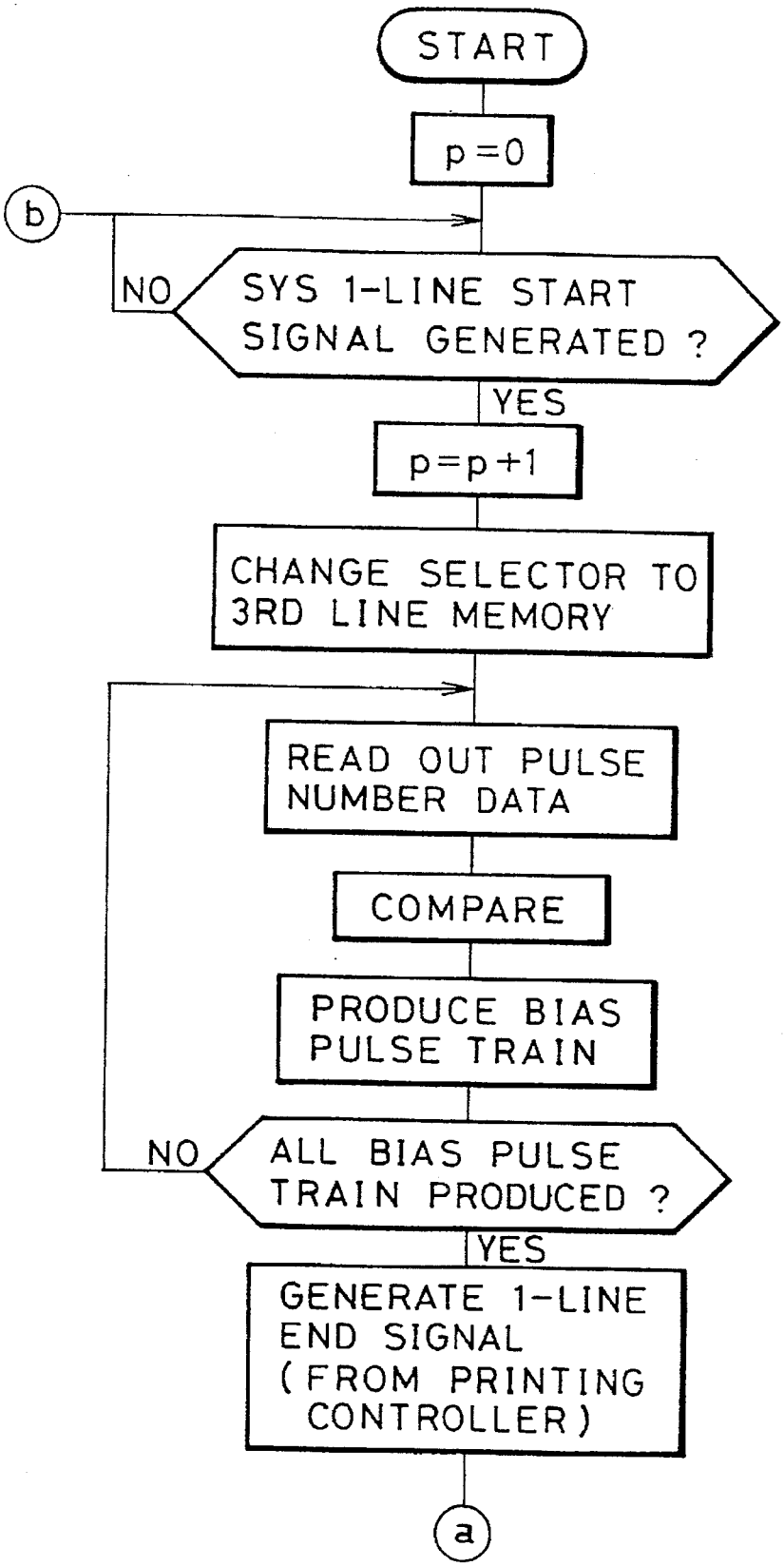
FIGS. 8A and 8B are flow charts illustrating operation of the thermal printer.
Figure 8B:
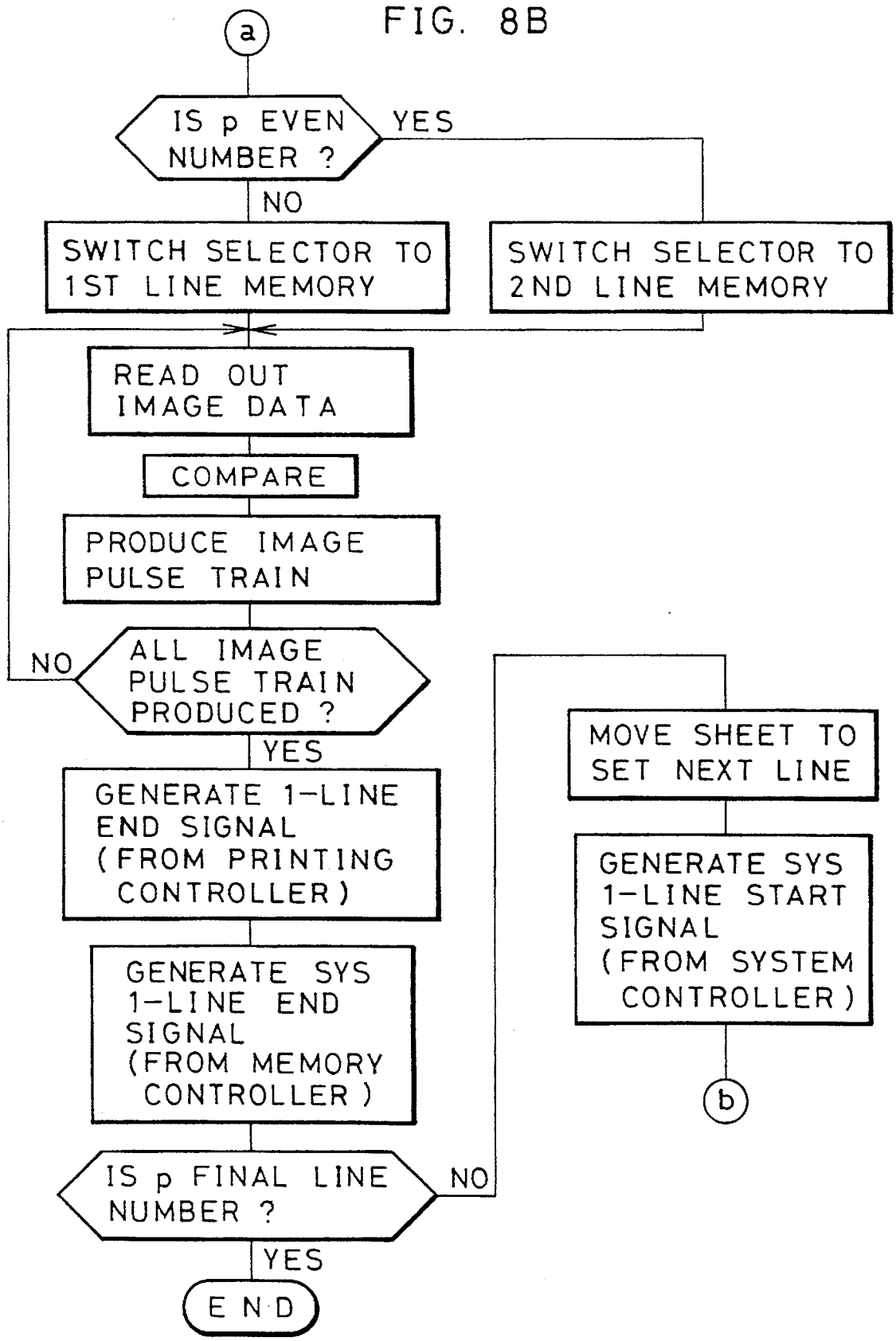

Operation of the above-constructed embodiment is described with reference to the flow chart of FIG. 8. At first a print start switch (not shown) is operated. The system controller 35 causes the platen drum 10 to rotate with the recording sheet 12. During the transportation of the recording sheet 12, the system controller 35 reads the image pulse number data NG of the first line for the yellow color by each pixel, and writes the image pulse number data NG to the first line memory 32. To regularize the distribution of the temperature of the heating elements with reference to the main scanning direction, the bias pulse number data NB is read out and written to the third line memory 34.

The platen drum 10 is rotated in intermittent fashion at regular steps. An advancing edge of a printing area on the recording sheet 12 comes to a position under the thermal head 14, to allow printing of a first line. The system controller 35 generates the SYS 1-LINE START signal and sends it to the memory controller 42, which responsively connects the selector 40 to the third line memory 34. The bias pulse number data NB of the respective heating elements are sent to the comparator 41. The memory controller 42 generates the 1-LINE START signal and applies it to the printing controller 43. The printing controller 43 responds to the 1-LINE START signal, and sends the comparative data C to the comparator 41. Occurrences of the 1-LINE START signal are being counted. If the present number of times that the 1-LINE START signal has occurred is odd, then the comparative data C for the bias heating is supplied as "1" to "FF". If the present number of times that the 1-LINE START signal has occurred is even, then the comparative data C for the image heating is supplied as "1" to "FF". In the embodiment, there are 255 bodies of the comparative data C commonly to the bias heating and the image heating. At most 255 pulses are generated. It is however possible to change the pulse number data NB and/or NG between the three colors. The comparative data C can be determined compatibly.

The comparator 41 compares the bias pulse number data NB of each heating element with the comparative data C generated by the printing controller 43, and generates the drive data consisting of the result of the comparison. The serial drive data of the one line generated by the comparator 41 is sent to the shift register 45, and shifted in the shift register 45 by the clock, to be converted into drive data having a parallel form. The system controller 35 then causes the latch circuit array 46 to latch the parallel drive data. The latched drive data is inputted to the AND gate array 47.

When a strobe command signal for the bias heating is generated by the printing controller 43, the strobe signal generator 44 sends the strobe signal for the bias heating to the AND gate array 47. The AND gate array 47 generates a bias pulse, both if the drive data is "1" and if the AND gate array 47 receives the strobe signal. The bias pulse turns on one of the transistors, for example 48*a*, so that the heating element 17*a* is energized to start the bias heating.

Similarly, the comparator 41 compares the bias pulse number data NB and the comparative data C successively. According to the result of the comparison, each heating element is supplied with drive pulses in number associated with a position of the heating element. As illustrated in the lower half of FIG. 6, the heating elements 17E of the end positions are driven by a greater number of drive pulses than the heating elements 17 of the middle. Accordingly the heating elements 17 inclusive of the elements 17E effect the bias heating in a regularized manner.

The printing controller 43 detects the end of the bias heating by checking how great the comparative data C is at present. At the end of the bias heating, the 1-LINE END signal is sent to the memory controller 42. The memory controller 42 responds to the 1-LINE END signal, changes over the selector 40, and provides the comparator 41 with the image pulse number data NG of the first line memory 32. The 1-LINE START signal is sent to the printing controller 43. The printing controller 43 receives the 1-LINE START signal of the second occurrence. The number counted in the counter in the printing controller 43 becomes even. The printing controller 43 sends "1" to "FF" as comparative data C for the halftone serially to the comparator 41. The comparative data C is compared with the image pulse number data NG of the yellow color for the first line as read out of the first line memory 32. If the yellow color is to be recorded for a pixel, the comparator 41 generates "1". If no yellow color is to be recorded for a pixel, the comparator 41 generates "0".

The drive data of one line generated by the comparator 41 is sent to the AND gate array 47 past the shift register 45 and the latch circuit array 46. Only the heating elements for which the drive data is "1" are energized during occurrence of the strobe signal. Similarly, the image pulse number data of one line is compared with the image comparative data of steps from "2" to "J", so that each heating element is driven by image drive pulses, to provide image heat energy for the recording sheet 12.

The upper half of FIG. 6 illustrates an image pattern. The lower half of FIG. 6 illustrates the number of drive pulse train supplied for heating elements in recording of the center line CL. The image pattern consists of a middle portion PA1 and a peripheral portion PA2. The middle portion PA1 has a dark gray color. The peripheral portion PA2 has a light gray color. To record the image pattern, the pulse number data NB in FIG. 6 is used. The image data has a pulse number which is determined in accordance with the image pattern. The bias data has a pulse number as a sum of the number data NBb of the basic bias pulses and the number data NBc of the density correcting pulses PC, where the number data NBb is indicated by the phantom line. The number data NBc of the correcting pulses PC is determined to increase toward the ends E relative to the main scanning direction M, to regularize the distribution of the temperature. The number data NBb of the basic bias pulses is "32" for the yellow color, "72" for the magenta color, and "113" for the cyan color. The number data NBc of the correcting pulses is at most "10" for the yellow color, is at most "36" for the magenta color, and is at most "50" for the cyan color. Those values are examples of NBb and NBc, which can be determined in accordance with characteristics of the thermal head and the recording sheet. With the bias pulse train supplied to the heating elements, the array of the heating elements has flat distribution of the halftone. Then the heating elements are supplied with the image pulse train based on the number data NG of the image pulses.

During the reading of the image pulse number data NG out of the first line memory 32, the system controller 35 changes over the selector 31, reads the image pulse number data NG of the second line out of the frame memory 30, and writes it to the second line memory 33. The line memory has stored the image pulse number data NG of next line before the start of the recording of next line, so that the printing can be effected with great efficiency. Similarly, the image pulse number data NG of one certain line is read out of one of the line memories 32 and 33 at the same time that the image pulse number data NG of next line is written to the remaining memory of the two.

After generation of the image pulse train for the first line, the printing controller 43 sends the 1-LINE END signal to the memory controller 42 for the second time. In response to the second occurrence of the 1-LINE END signal, the memory controller 42 sends the SYS 1-LINE END signal to the system controller 35. The system controller 35 detects the end of recording the first line in response to the SYS 1-LINE END signal, and causes the platen drum 10 to rotate at the amount of the one line, to transport the recording sheet 12. In the sheet transportation, the system controller 35 sends the SYS 1-LINE START signal to the memory controller 42, which in turn changes over the selector 40, and causes it to transmit the bias pulse number data NB from the third line memory 34 to the comparator 41. As is described in the above, the bias pulse train is generated, before the second line memory 33 is selected through the selector 40. The image pulse train is generated in accordance with the image pulse number data NG of the second line. K bias pulses and J image pulses in all are supplied for the respective heating elements, to record the second line, where K is at most 255, and J is at most 255. Similarly, the third and following lines are recorded thermally, until the yellow color of the one frame is all recorded.

FIG. 7 illustrates a train of drive pulses supplied to one of the heating elements 17E positioned at the ends of the thermal head 14. The pulse train is constituted of the basic bias pulse train PBbG, the correcting pulse train PBcG, and the image pulse train PGG, which succeed in the order listed. The image pulse train PGG has the image pulses PG of which the number represents the halftone level.

In the recording of the yellow color, portions colored yellow in the recording sheet 12 are moved under the yellow fixing lamp 16 by the rotation of the platen drum 10, as illustrated in FIG. 1. The yellow fixing lamp 16 applies near-ultraviolet rays in the vicinity of 420 nm to the recording sheet 12. Diazonium salt compound included in the yellow coloring layer 23 is decomposed to destroy the coloring ability.

The platen drum 10 makes one rotation, to locate the recording area at the thermal head 14 for the second time. The magenta image is recorded line after line. The magenta recording uses the number data NBbM of the basic bias pulses, of which the number is greater than the number data NBbY of the basic bias pulses for the yellow color. Thus the comparatively great heat energy is provided for the recording sheet 12. As the yellow coloring layer 23 has been fixed photochemically, the yellow coloring layer 23 is not colored any further, in spite of the heat energy for the magenta color. With the magenta image recorded, the recording sheet 12 is supplied with the ultraviolet rays of the vicinity of 365 nm by the magenta fixing lamp 15, to fix the magenta coloring layer 22.

One more rotation of the platen drum 10 brings the recording area to the position under the thermal head 14. Lines of an image of the cyan color are recorded by heating the cyan coloring layer 21. The cyan coloring layer 21 has no photochemical fixability, as the cyan coloring layer 21 to be colored requires heat energy which is so high that it is never produced by ordinary environment in the preservation of the recording sheet 12. In the recording of the cyan coloring layer 21, the fixing lamps 15 and 16 are kept turned off. The number data NBbC of the basic bias pulses for the recording of the cyan color is greater than the number data NBbM for the magenta color.

In the embodiment, the bias pulse number data NB is stored for each heating element as a sum of adding the correcting pulse number NBc to the basic bias pulse number NBb. Instead, it is possible for a storage to store the basic bias pulse number NBb and the correcting pulse number NBc, which can be added up by a digital calculating section to obtain the bias pulse number NB.

Figure 9:
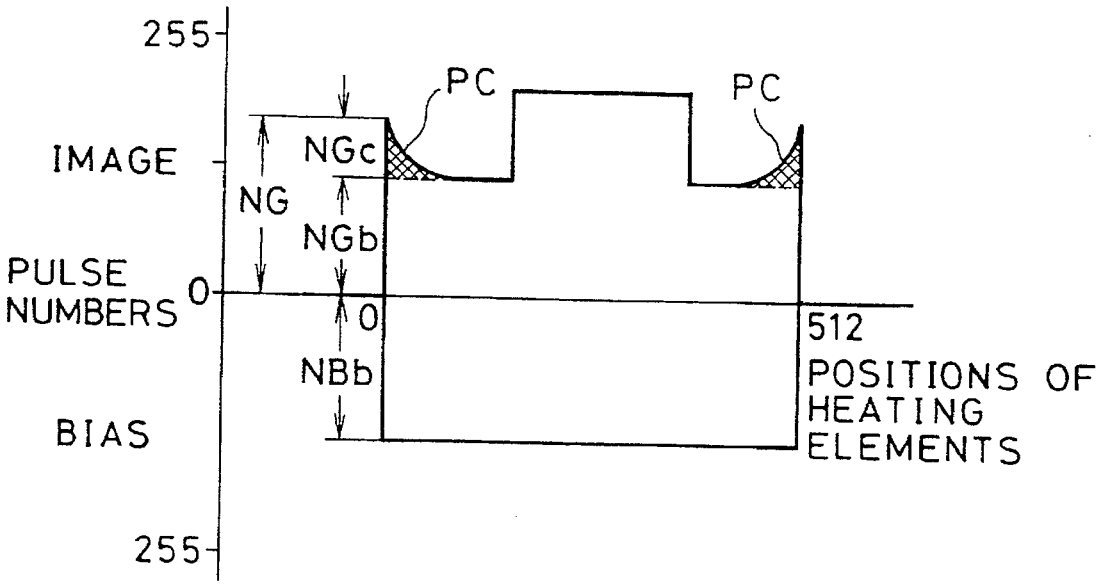
FIG. 9 is an explanatory view in graph, illustrating another preferred embodiment, in which the density is corrected in the heating for the halftone.

In the above embodiment, the density is corrected in the bias heating. Alternatively the density can be corrected in the image heating as illustrated in FIG. 9. To reproduce the image pattern in the upper half of FIG. 6, the center line CL is recorded by drive pulses in FIG. 9. In accordance with the image data, there are basic image pulses of which the number is represented by number data NGb. Number data NGc of correcting pulses is added to the basic image pulse number data, to obtain a sum which is a number data NG of a train of image pulses. The recording sheet 12 is heated by the supply of this train of the image pulses, so that the density is corrected. Note that the maximum density to be reproduced by the basic image pulses may be set at 200 steps or so out of the 255 steps represented by the pulses, so that the correcting pulses can be generated within the range of the remaining 55 steps. Let the lateral portions PAE be provided with the maximum coloring density. Should 255 steps be assigned to the basic image pulses, it would be impossible to add correcting pulses to the basic image pulses although the lateral portions PAE should be corrected by the pulse addition. However the assignment of the 200 steps to the basic image pulses overcomes such a problem.

The above embodiment is related to the line printer. Alternatively the present invention is applicable to a serial printer in which the lines are recorded in course of movement of a thermal head. The recording density is corrected in positions at end portions of an array of linearly arranged heating elements, so that a border defined between adjacent two of the plural lines is prevented from having excessively smaller density. The lines will never be involved with any conspicuous portions with small density like belts between the lines. The present invention is also applicable to the recording of multi-images in the line printer, such as four sub-images in combination in the single frame: there may be an occasion where one sub-image of the four is printed as a blank; a sub-image adjacent to a block of the blank is prevented from having low-density edges which would occur conspicuously in conventional fashion.

In the embodiments, the irregularities in the temperature relative to the main scanning direction M are corrected in supposition of equality in resistance among the heating elements. However there may be irregularities in resistances of the heating elements. It is possible to measure the resistances, produce correcting data in accordance with detected differences between the resistances, and correct the irregularities in density by use of the correcting data.

In the above embodiments, the correcting pulses are unchanged in the sub scanning direction S. However it is also possible to change the numbers of the correcting pulses in accordance with the numbers of the lines to be arranged in the sub scanning direction S. Therefore the density all over the printing area can be regulated without shortage, to raise the quality of the recorded image.

In the above, the first to third line memories 32 to 34 are disposed to be changed over through the selector 40. Alternatively an area in a memory can be divided in three to constitute the line memories. The divided areas can be selectively read by the memory controller. In the above, the embodiment is related to the printer of a direct thermal recording type. The present invention is also applicable to a printer of a thermal transfer recording type. In the above, the numbers of the bias pulses and the image pulses are different between the three colors. Instead, it is possible to set different durations in turning on/off the strobe signals. It is also possible to combine the change in the pulse number and the change in on/off durations of the strobe signals, both for the three colors. In the above, the strobe signals have different lengths between the bias heating and the image heating. However, a strobe signal may have a single length in common to the bias heating and the image heating. With the common strobe signal, numbers of pulses can be changed compatibly to the amounts of heat energy to be applied.

In the above embodiments, the density of all the colors including yellow, magenta and cyan is corrected. It is possible to correct only the density of the magenta and cyan, or to correct only the density of the cyan, because coloring layers closer to the obverse layer are the less influenced by the heat distribution of the thermal head.

There may be a thermal printer of which a thermal head is locally cooled in positions different from lateral ends. The present invention is applicable to such a printer, as the remarkably cooled portions of the thermal head can be pre-detected by experiments to preset data for correcting the density.

The present invention is applicable to a thermal printer in which a color thermosensitive recording sheet is reciprocally moved instead of being rotated for full color printing. For the reciprocation, it is possible to dispose a platen roller or plate having a small size for supporting the recording sheet, and pairs of transport rollers located upstream and downstream of said platen for moving the recording sheet reciprocally.

The present invention is also applicable to a thermal printer having three thermal heads, respectively for the yellow, magenta and cyan colors. The recording sheet on the platen drum can be colored for the full color printing only by one rotation of the platen drum (so-called "one-pass type").

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal recording method for recording an image on a thermosensitive recording material with a thermal head, said thermal head having plural heating elements arranged in a main scanning direction, said heating elements being driven while said thermal head and said recording material are moved relative to each other in a sub scanning direction perpendicular to said main scanning direction to apply bias heat energy and image heat energy to said recording material so as to thermally record an ink dot on said recording material, said bias heat energy being determined to heat said recording material substantially to a temperature at which said recording material starts being colored and said image heat energy being determined in accordance with image data of the image, the thermal recording method comprising:

applying density correcting heat energy to said recording material through a first group of heating elements of said thermal head, said heating elements of said first group being so located that heat dissipates therefrom fastest among said plural heating elements, said density correcting heat energy preventing recording density from being lowered due to dissipation of heat, said density correcting heat energy increasing toward ends of said thermal heads in said main scanning direction.

2. The thermal recording method as defined in claim 1, wherein said heating elements of said first group lie in positions close to the ends of said thermal head in said main scanning direction.

3. The thermal recording method as defined in claim 2, wherein said recording material is a thermosensitive recording sheet, a rotatable platen drum supporting said recording sheet on a periphery thereof, said thermal head extending linearly and substantially in parallel to a rotational axis of said platen drum.

4. The thermal recording method as defined in claim 3, further comprising the steps of:

obtaining a resistance error of said heating elements, said resistance error being a difference between a reference resistance and resistances of said heating elements; and correcting said bias heat energy in consideration of said resistance error to render said bias heat energy equal among said heating elements while eliminating influences of said resistance error.

5. The thermal recording method as defined in claim 3, wherein said recording material is color thermosensitive recording material including a support and at least first to third thermosensitive coloring layers formed on said support in order, said first to third thermosensitive coloring layers being colored yellow, magenta and cyan, said third thermosensitive coloring layer having a maximum heat sensitivity, said first thermosensitive coloring layer having a minimum heat sensitivity, and said ink dot being recorded in frame-sequential fashion in an order from said third thermosensitive coloring layer to said first thermosensitive coloring layer, and said density correcting heat energy being determined in consideration of said heat sensitivity as lowest for said third thermosensitive coloring layer and as highest for said first thermosensitive coloring layer.

6. The thermal recording method as defined in claim 5, wherein said first thermosensitive coloring layer is cyan colored, said second thermosensitive coloring layer is magenta colored, and said third thermosensitive coloring layer is yellow colored.

7. The thermal recording method as defined in claim 1, wherein said bias heat energy is generated by supplying said heating elements with a bias pulse train and said image heat energy is generated by supplying said heating elements with an image pulse train following said bias pulse train, and said density correcting heat energy is generated by supplying said heating elements of said first group with a train of density correcting pulses, said density correcting pulses increasing in number toward the ends of said thermal head in said main scanning direction.

8. The thermal recording method as defined in claim 7, wherein said bias pulse train includes basic bias pulses and said density correcting pulses, and said basic bias pulses are produced in such a number that a second group of heating elements heat said recording material substantially to said temperature of starting coloring said recording material, said heating elements of said second group lying in a middle of said thermal head.

9. The thermal recording method as defined in claim 7, wherein said image pulse train includes basic image pulses and said density correcting pulses, and said basic image pulses are produced in such a number that a second group of heating elements record said ink dot to have said recording density associated with said image data of the image, said heating elements of said second group lying in a middle of said thermal head.

10. The thermal recording method as defined in claim 9, wherein said number of said basic image pulses when maximizing said density of said recording ink dot is determined smaller than a pulse number of said image pulse train when maximizing said image heat energy, and said image heat energy is maximized if both numbers of said density correcting pulses and said basic image pulses are maximized.

11. A thermal printer, including a thermal head having plural heating elements arranged in a main scanning direction, said heating elements being driven by supply of a bias pulse train and an image pulse train while said thermal head and a recording material are moved relative to each other in a sub scanning direction perpendicular to said main scanning direction to heat said recording material so as to thermally record an ink dot in a line on said recording material, said bias pulse train being produced to heat said recording material substantially to a temperature at which said recording material starts being colored and said image pulse train being produced in accordance with image data of an image, the thermal printer comprising:

a bias data memory for storing bias data representing a pulse number of said bias pulse train for said heating elements, said bias pulse train including basic bias pulses and density correcting pulses, said basic bias pulses being produced in such a number that said heating elements of a first group heat said recording material substantially to said temperature of starting coloring of said recording material, said heating elements of said first group lying in a middle of said thermal head, said density correcting pulses being supplied for a second group of heating elements lying in positions close to two ends of said thermal head in said main scanning direction, said density correcting pulses being produced in such a number as to compensate heat deficit caused by heat dissipation from said thermal head;

a bias data line memory for storing said bias data of one line for each of said heating elements, said bias data being read out from said bias data memory;

an image data line memory for storing said image data of said one line, said image data representing a pulse number of said image pulse train for said heating elements; and a driver section, for reading said bias data of said one line out of said bias data line memory, for reading said image data of said one line out of said image data line memory, and for converting said bias data and said image data respectively into said bias pulse train and said image pulse train following said bias pulse train, to record said ink dot of said one line.

12. The thermal printer as defined in claim 11, wherein said density correcting pulses are produced increasingly in number toward said ends of said thermal head in said main scanning direction.

13. The thermal printer as defined in claim 12, wherein said recording material is a thermosensitive recording sheet, the thermal printer further comprising:

a rotatable platen drum for supporting said recording sheet on a periphery thereof, said thermal head extending linearly and substantially in parallel to a rotational axis of said platen drum.

14. The thermal printer as defined in claim 13, wherein said driver section comprises:

a system controller, for writing said bias data of said one line into said bias data line memory and for writing said image data of said one line into said image data line memory;

a memory controller, for initially reading said bias data of said one line out of said bias data line memory and for subsequently reading said image data of said one line out of said image data line memory to record said ink dot of said one line; and a converter device for converting said bias data and said image data respectively into said bias pulse train and said image pulse train.

15. The thermal printer as defined in claim 14, wherein said converter device comprises:

a printing controller, for generating bias comparative data in synchronism with reading of said bias data, and for generating image comparative data in synchronism with reading of said image data;

a comparator for comparing said bias data with said bias comparative data, to convert said bias data into said bias drive data in binary form, and for comparing said image data with a image comparative data, to convert said image data into said image drive data in binary form;

a strobe signal generator for generating said bias strobe signal if said bias drive data is generated, and for generating said image strobe signal if said image drive data is generated; and a pulse generator, for producing said bias pulse train from said bias strobe signal and said bias drive data, and for producing said image pulse train from said image strobe signal and said image drive data.

16. The thermal printer as defined in claim 15, wherein said image data line memory comprises at least first and second image line memories, said image data being read out of said first image line memory while image data of a line following said one line is written into said second image line memory.

17. A thermal printer comprising:

a thermal head having a plurality of heating elements arranged in a main scanning direction of the thermal printer, the plurality of heating elements including respective groups of heating elements at opposite ends of said thermal head in the main scanning direction;

image data generation means for generating image data;

bias data generation means for generating bias data, the bias data for the heating elements of the respective groups of heating elements increasing in value toward the ends of said thermal head; and driving means, coupled to said image data generation means and said bias data generation means, for driving the plurality of heating elements of said thermal head with the image data and the bias data.

18. The thermal printer of claim 17, wherein the image data and the bias data comprise pulse number data indicative of the number of pulses to be applied to the plurality of heating elements.

19. The thermal printer of claim 17, wherein the bias data comprises first bias data selected to heat the plurality of heating elements to approach a temperature at which printing occurs and second bias data selected to compensate for heat loss from the respective groups of heating elements.

20. The thermal printer of claim 17, further comprising:

error means for determining resistance errors of the plurality of heating elements as a difference between reference resistances and actual resistances of the plurality of heating elements; and correction means for correcting the bias data in accordance with the determined resistance errors.

21. A method of thermal printing using a thermal head having a plurality of heating elements arranged in a main scanning direction, the plurality of heating elements including respective groups of heating elements at opposite ends of the thermal head in the main scanning direction, the method comprising the steps of:

generating, image data;

generating bias data for the heating elements of the respective groups of heating elements, the bias data increasing in value toward the ends of the thermal head; and driving the plurality of heating elements of the thermal heads with the image data and the bias data.

22. The method of thermal printing of claim 21, wherein said step of generating image data and said step of generating bias data respectively comprise generating pulse number data indicative of the number of pulses to be applied to the plurality of heating elements.

23. The method of thermal printing of claim 21, wherein said step of generating bias data comprises generating first bias data selected to heat the plurality of heating elements to approach temperature at which printing occurs and second bias data selected to compensate for heat loss from the respective groups of heating elements.

24. The method of thermal printing of claim 21, further comprising the steps of:

determining resistance errors of the plurality of heating elements as a difference between reference resistances and actual resistances of the plurality of heating elements; and correcting the bias data in accordance with the determined resistance errors.

25. A thermal printer comprising:

a thermal head having a plurality of heating elements arranged in a main scanning direction of the thermal printer, the plurality of heating elements including respective groups of heating elements at opposite ends of said thermal head in the main scanning direction;

image data generation means for generating image data;

bias data generation means for generating bias data;

printing density correction means for correcting the image data for the plurality of heating elements to compensate for heat loss by increasing the image data of the heating elements of the respective groups in value toward the ends of said thermal head; and driving means, coupled to said printing density correction means and said bias data generation means, for driving the plurality of the heating elements of said thermal head with the corrected image data and the bias data.

26. A method of thermal printing using a thermal head having a plurality of heating elements arranged in a main scanning direction, the plurality of heating elements including respective groups of heating elements at opposite ends of the thermal head in the main scanning direction, the method comprising the steps of:

generating image data;

generating bias data;

correcting the image data for the plurality of heating elements to compensate for heat loss by increasing the image data for the heating elements of the respective groups of heating elements in value toward the ends of the thermal head; and driving the plurality of heating elements of the thermal heads with the corrected image data and the bias data.

* * * * *

UNITED STATES PATENT AND TRADEMARK OFFICE

CERTIFICATE OF CORRECTION

PATENT NO. : 5,661,512
DATED : August 26, 1997
INVENTOR(S) : Hiroshi FUKUDA et al.

It is certified that error appears in the above-indentified patent and that said Letters Patent is hereby corrected as shown below:

On the title page, item [30],

In the Foreign Application Priority Data section:

Please change "6-0198658" to --6-19658--.

Signed and Sealed this

Eighteenth Day of August, 1998

Bruce Lehman

*Attest:*

BRUCE LEHMAN

*Attesting Officer*

*Commissioner of Patents and Trademarks*